United States Patent [19]

Rotolico

[11] 4,308,996

[45] Jan. 5, 1982

[54] ADJUSTABLE HEAD FOR SELECTIVELY SHAPING A FLAME-SPRAY DISCHARGE

[75] Inventor: Anthony J. Rotolico, Hauppauge, N.Y.

[73] Assignee: Eutectic Corporation, Flushing, N.Y.

[21] Appl. No.: 131,199

[22] Filed: Mar. 17, 1980

[51] Int. Cl.[3] ..... B05B 1/28

[52] U.S. Cl. ..... 239/290; 239/301

[58] Field of Search ..... 239/79, 85, 81, 301, 239/292, 290, 291, 293, 296, 300

[56] References Cited

U.S. PATENT DOCUMENTS 1,739,428 12/1928 Tracy ..... 239/301
1,752,922 4/1930 Mueller ..... 239/301 X
1,760,373 5/1930 Perrin ..... 239/301
2,743,963 5/1956 Peeps ..... 239/296 X

*Primary Examiner*—Robert B. Reeves
*Assistant Examiner*—Gene A. Church
*Attorney, Agent, or Firm*—Hopgood, Calimafde, Kalil, Blaustein & Judlowe

[57] ABSTRACT

The invention contemplates a selectively operative flame-shaping feature in application to a powder-spraying gas torch, whereby directional jets of compressed-air or other pressure fluid may be discharged into angularly spaced off-axis regions of a developing flame spray, with selective rotational adjustment of the angular orientation of jet discharge with respect to the axis of flame-spray discharge.

20 Claims, 9 Drawing Figures

ADJUSTABLE HEAD FOR SELECTIVELY SHAPING A FLAME-SPRAY DISCHARGE

BACKGROUND OF THE INVENTION

The invention relates to flame-spraying of powdered material with a combustion gun and is particularly concerned with the use of air jets to intersect hot particles of material at a given distance downstream from the location of gun discharge, thereby increasing the velocity of molten particles entrained in the gas stream.

Present devices to achieve this result are of themselves relatively cumbersome, and they encumber the gun or torch to which they are applied. They require special adjustments, and torch shutdown, from one kind of spray run to another. They also require special hose connections which interfere with powder-supply devices and connections, so that even when shut down for a resetting adjustment, the operator has only a limited range of angular-adjustment options in use of his torch.

BRIEF SUMMARY OF THE INVENTION

It is an object to provide an improved hot-particle accelerating device for use in a combustion gun or torch of the character indicated, avoiding encumbrances and other limitations of past devices.

A specific object is to achieve effectively a full 360-degree range of selectable rotational orientation of pressure-fluid jet discharge, with respect to the flame-spray axis of such a gun or torch.

Another specific object is to achieve the above objects with a structure which permits angular-orientation adjustment at all times, including during continuous flame-spraying operations.

A further specific object is to provide pressure-fluid jet-discharge accessory apparatus for a flame-spray torch, with the selectively available feature of converting the effective sectional distribution of applied hot particles to that of a wide but slender ribbon, having a major directional axis which can be angularly oriented at will, without reorienting the torch itself.

It is also a specific object to meet the above objects with structure which will releasably retain one of a plurality of discharge heads selected for its properties in the light of particular job requirements.

A general object is to achieve the above objects with relatively simple, inexpensive and rugged structure.

The above objects and other features of novelty and invention are realized by providing a sealed manifold for supplying pressure fluid to one or more particle-accelerating discharge jets, wherein jet-discharge structure communicates with the manifold and is fully rotationally adjustable about the torch-discharge axis at all times, and wherein a fixedly mounted part of the manifold provides an angularly fixed point of pressure-fluid supply to the manifold. The fixed angular location of pressure-fluid supply connection is selected for its freedom from viewing obstruction of the coating or other operation performed by the torch.

DESCRIPTION OF PREFERRED EMBODIMENTS

The accompanying drawings illustrate preferred embodiments of the invention. In these drawings.

Figure 1:
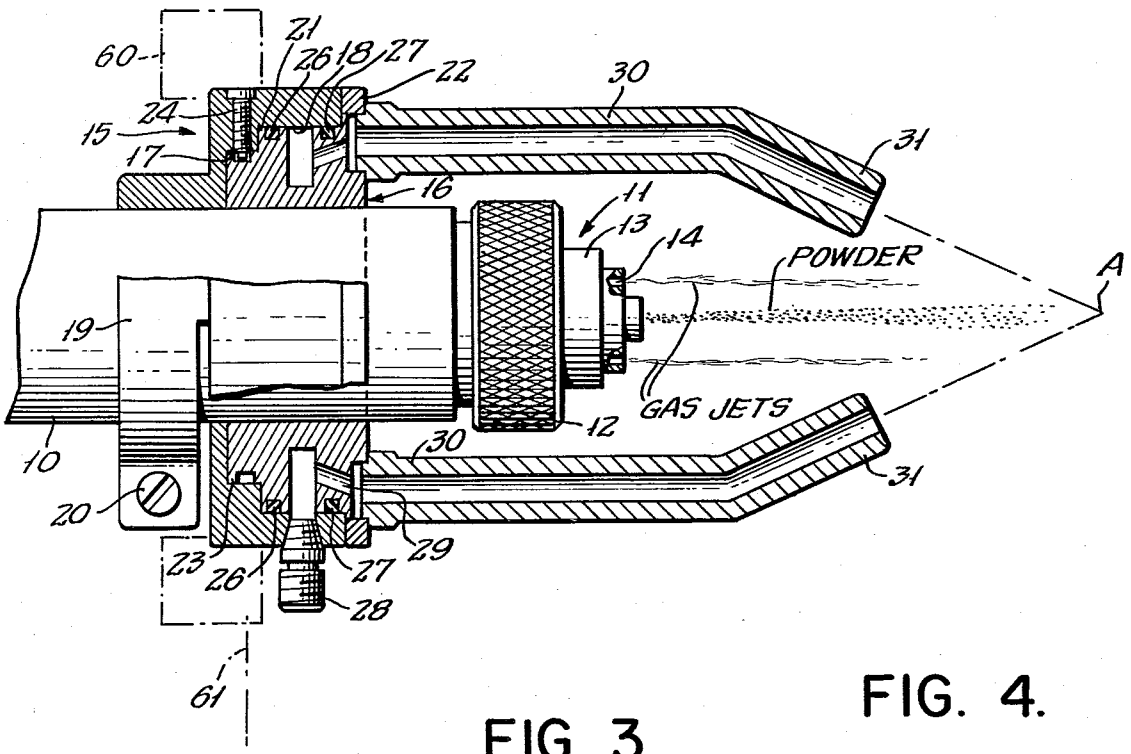
FIG. 1 is a partly broken-away longitudinal sectional view of adjustable flame-shaping jet structure of the invention, in application to a simplified fragmentary showing of the gas distributor and nozzle region of a flame-spraying torch.
Figure 2:
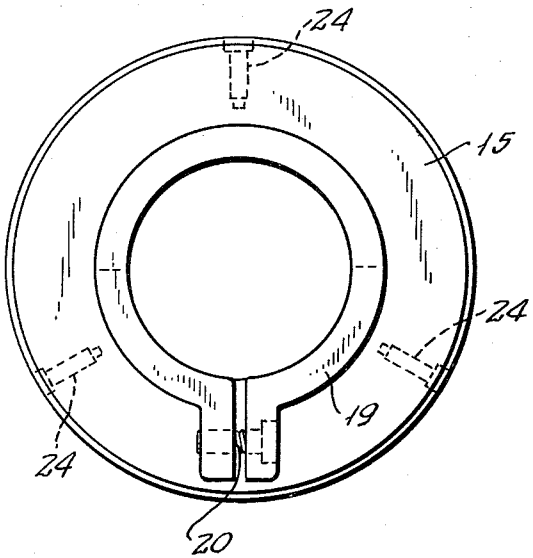
FIG. 2 is a left-end view of the structure of FIG. 1.

In FIGS. 1 and 2, the invention is shown in application to the cylindrical barrel 10 of a nozzle assembly 11 of a gas torch, for example, an oxy-acetylene torch wherein gas-distribution and mixing occur within barrel 10. A knurled locking nut 12 has threaded engagement to the end of barrel 10, for clamped retention of a nozzle insert 13. The insert 13 includes a ring of spaced ports 14 having suitable internal supply connection within barrel 10 for downstream-directed discharge of combustible gas mixture. The flame supplied by ports 14 thus has an annular base at gas discharge from assembly 11. And within the annular base of the flame, a central powder-discharge port (suitably supplied within barrel 10) discharges powder materials to be flame-sprayed upon a workpiece surface.

The flame-shaping device of the invention comprises a fixed flanged member 15 and a rotatable ring-member 16. Flanged member 15 is generally cup-shaped, having a bore 17 and a cylindrical counterbore 18 open to its downstream end; member 15 is also characterized by a split mounting boss 19 at its upstream end, for clamped engagement to barrel 10 upon take-up of a clamp bolt 20. To cooperate with fixed member 15, the ring member 16 has a primary cylindrical land 21 having a telescoped fit to the counterbore 18; land 21 is located between (a) a radially outward flange 22 defining a shoulder adjacent the downstream end of fixed member 15 and (b) a reduced land 23 received in the bore 17. Angularly spaced locating bolts 24 carried by the fixed member 15 extend into a peripheral groove in land 23, to establish an axially located but selectively rotatable relation between members 15–16, and an external knurl on the exposed outer surface of flange 22 facilitates manual control of such rotation.

Members 15–16 coact to define an annular manifold 25 between axially spaced O-ring seals 26–27 along the telescoped fit of surfaces 18–21. As shown, the O-rings are located in radially outward grooves in the rotatable-ring-member surface 21, and a deep third groove between the O-ring grooves defines the cavity of manifold 25, closed by the counterbore 18. Pressurized air or inert gas is supplied to manifold 25 via an inlet-port fitting 28 in fixed member 15, and manifold 25 discharges via passages 29 to two diametrically opposite jet-conduit members 30. Reduced ends of conduit members 30 are seated in shallow bores in the downstream face of ring member 16 and are permanently secured thereto, as by brazing. Ring member 16 is thus combined with the conducit members to define a unitary component which may be replaceably fitted to the fixed member 15 merely by operation of the retaining bolts 24.

The conduit members 30 extend parallel to the torch-discharge axis and at symmetrically opposed offsets therefrom, and their discharge ends are inwardly canted at 31, for torch-axis convergence and intersection at A, being at a substantial downstream offset from their discharge locations. It will be understood that the clamped location of boss 19 on barrel 10 will determine the axial offset of point A downstream from the torch-tip insert 11, and that this offset will be a matter for adjustable selection, depending upon torch operating parameters.

Figure 3:
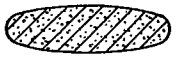
FIGS. 3 and 4 are simplified diagrams to illustrate different hot-particle sectional distribution patterns which are selectively available in use of the invention, in the course of a single flame-spraying run of the torch.
Figure 4:
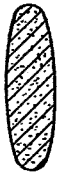

In operation, and with conduit members 30 in vertically spaced orientation, as suggested by FIG. 1, the air or inert-gas jet blasts discharged at 31 produce a flattening effect upon the powder-bearing flame from the torch tip, the resulting section of such flame at substantially the location A being ribbon-like and horizontally oriented, as schematically depicted by the sectional diagram of FIG. 3. Now, if the nature of the flame-spraying job requires a differently oriented ribbon section, as for example the vertically oriented flame section depicted in FIG. 4, the torch operator need only manually grasp the knurl of flange 22 to impart the desired bodily rotation to ring member 16 and its discharge conduits 30. Such adjustment of orientation may be performed without shut-down of the torch or of its powder supply. In other words, the ribbon-flame orientation may be adjusted in the course of making a continuous flame-sprayed deposit of powdered metal, all as best befits the local orientation context of the workpiece-surface region receiving the deposit.

FIGS. 5 to 8 are similar fragmentary views to illustrate different functional inserts in place of the ring member 16 of FIG. 1.

Figure 5:
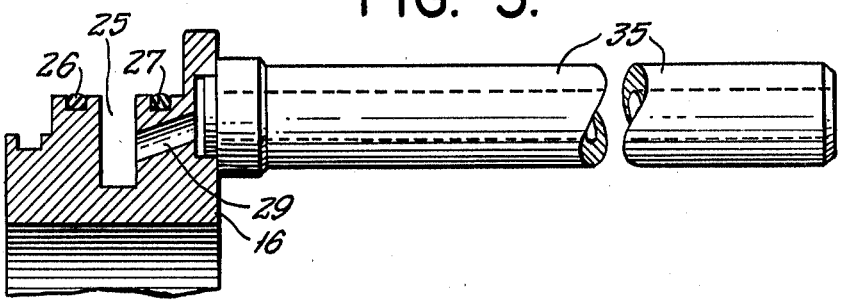
FIGS. 5, 6, 7 and 8 are simplified fragmentary sectional views to show selectively available different discharge-head configurations available for removable replacement of a part of the structure of FIG. 1.

In FIG. 5, the ring member 16 is equipped with a plurality of angularly spaced straight parallel conduit tubes or pipes 35, communicating via passages 29 with manifold 25. Being straight, their discharge is parallel to the flame spray. Thus, by discharging air or inert gas, they provide a cooling function at the region of application to the workpiece. To permit a degree of localized heat application to the workpiece, limited essentially only to the region to be coated; nearby workpiece surfaces which might be adversely affected by such heat are thereby protected. It will be understood that the number and length of conduit tubes 35 will depend upon job considerations.

Figure 6:
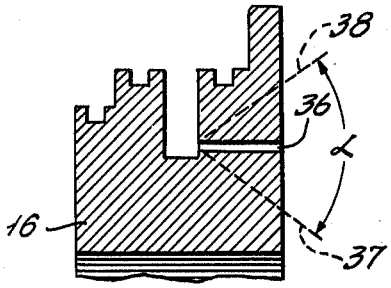

In FIG. 6, the ring member 16 is provided with a plurality of angularly spaced orifices 36, communicating with manifold 25, being preferably a large plurality, for example, to enable a cylindrical curtain or shroud of inert gas to envelop and protect the spraying flame, until its contact and reaction with the workpiece surface. Illustratively, in a ring member 16 wherein the locus of centers of such orifices 36 is a 2-in. diameter circle, the number of orifices may suitably be 20, of 1-mm. diameter. Orifice axes may be straight and parallel to the torch axis, as suggested by full lines for the orifice 36; however, for specialized purposes, the orifice axes may be convergent or divergent, within a relatively large angular range $\alpha$, i.e., between convergent and divergent limits 37–38, respectively.

Figure 7:
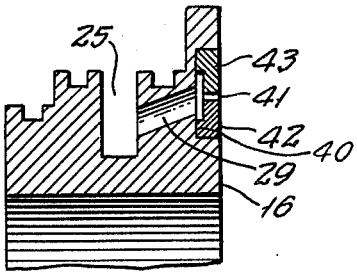

In FIG. 7, the discharge end face of ring member 16 is annularly recessed at 40, and the plural angularly spaced passages 29 communicate with recess 40. However, the recess 40 is converted into an annular orifice 41, by securing inner and outer ring inserts 42–43 to the respective adjacent surfaces of recess 40. The orifice 41 is thus circumferentially continuous, being defined by the radial offset between inserts 42–43, and it is noted that the combined effective sectional area of all passages 29 should equal or exceed the effective annular sectional area of orifice 41, to enable orifice 41 to produce an effectively circumferentially continuous protective discharge of flame-shrouding gas.

Figure 8:
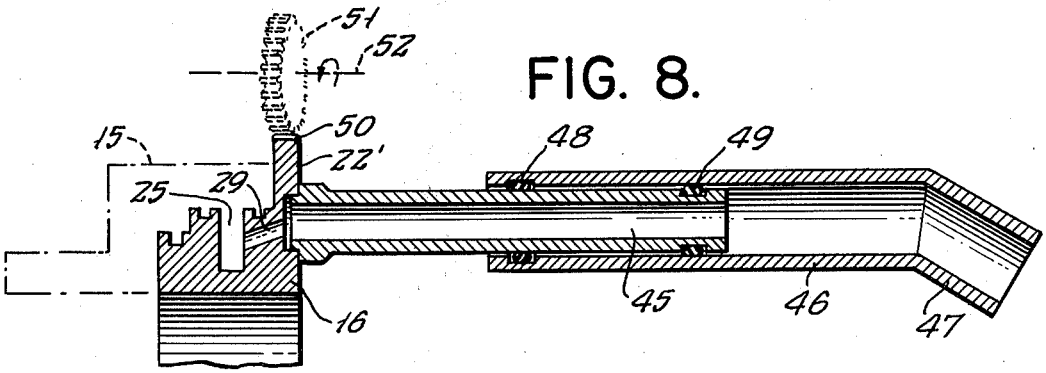

In FIG. 8, the ring member 16 will be seen to be equipped with one or more spaced conduit pipes 45, in the manner described at 35 in FIG. 5. In FIG. 8, however, an adjustably telescoping extension pipe 46, fitted to each such base pipe 45, and having an inclined offset 47 at the discharge end, enables the blast from one conduit 45–46(47) to be delivered at one downstream location, while the blast from a diametrically opposite conduit 45–46(47) is delivered at a different downstream location, as for particular flame-spray shaping purposes. Spaced O-rings 48–49, respectively carried by a bore groove at the inlet end of pipe 46 and at the discharge end of pipe 45, seal and frictionally retain adjusted settings of (a) longitudinal position and (b) angular orientation of the discharge ends of the adjustably movable pipes 46; thus, with the same adjusted angular offset of ends 47, i.e., offset in the same sense away from strict convergence to the torch axis, the device of FIG. 8 may provide a helically developed swirl of protective gas around the flaming spray discharge from fitting 11.

FIG. 8 additionally illustrates schematically that, in place of knurl formations, the flange 22′ of ring member 16 may extend slightly beyond the outer diameter of the flange member 15, and that it may be formed with gear teeth 50 for motor-driven engagement with the pinion 51 on a drive axis 52, thereby imparting continuous (or otherwise controlled) rotation to the ring member 15 and to the jet-discharge means carried thereby.

Figure 9:
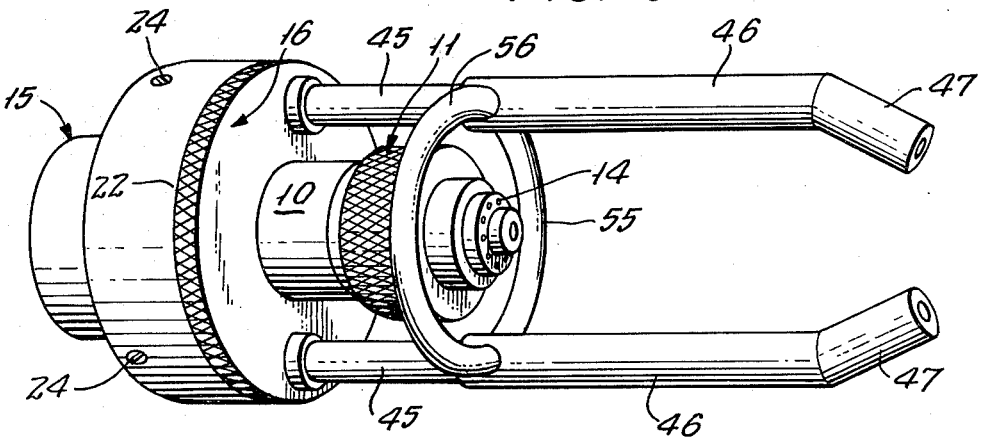
FIG. 9 is a simplified view in perspective to show another removably replaceable alternative.

In FIG. 9, the discharge face of ring member 15 is again equipped with diametrically opposed pipes 45, which may be as described in FIG. 8. However, the adjustably positionable discharge pipes 46(47) which have telescoping fit to pipes 45 are ganged together by arcuate bridge connections 55–56. It will be understood that bridge connections 55–56 retain the fixed angular offset at 47 by which they are originally secured to connections 55–56, so that the device of FIG. 9 has specific utility when such angular offsets are to be maintained while flexibility is preserved for selective longitudinal placement of the discharge ends 47 with respect to the flame spray and/or the workpiece.

The described rotary jet feature for use in a gas torch, particularly a powder-spraying gas torch, will be seen to achieve all stated objects. Spray patterns can be adjusted at will, and in fact such patterns can be selectively varied in the course of applying a single continuous flame-spray coating to a workpiece. Alternative rotatable-member inserts are readily accommodated by simple screw-resetting at 24, to suit particular application requirements. The sprayed pattern may thus be adjusted, for example, to meet the changing nature of different substrate configurations on a single workpiece. Highest efficiency and coatings of premium quality may, therefore, be obtained.

While the invention has been described for preferred forms shown, it will be understood that modifications may be made without departure from the claimed scope of the invention. For example, an annular ring or bushing, suggested at 60 in FIG. 1, may be selected for its outer diameter to pilot along the bore of a tubular workpiece, bushing 60 being secured to fixed ring 15 by set-screw or the like means, suggested by a phantom radial set-screw alignment 61; in such case, the inlet fitting 28 will be understood to be sized and shaped (e.g., an "ell," rather than the nipple shown), as best suits the application. Such a piloting on the bore of the workpiece will enable a shaped flame spray to be applied along a straight or helical path in the workpiece bore, depending on whether ring member 16 is stationary or is rotated in the course of, say, a retracting longitudinal traverse of the workpiece bore.

It will also be understood that, although the rotatable head feature of the invention has been described in connection with compressed air or inert gas as the discharged medium, such use is only by way of illustration and is not limiting. Thus, hot gases, such as preheated air, or nitrogen may be supplied at 28 for such discharge, as also may combustible gases; in the latter event, each discharge (e.g., at 31) may support a separate flaming jet, directed at A in the primary flame spray attributable nozzle means 11, not only to shape the section of the flame spray, but also contributing accelerating action to the primary spray.

What is claimed is:

1. In a gas torch having a cylindrical flame-spraying nozzle including a nozzle insert releasably mounted at the downstream end of said torch and adapted for axial discharge of powder material centrally of a surrounding annulus of axially discharged combustible-gas mixture, the improvement comprising circumferentially continuous manifolding means including an annular ring rotatably mounted to and wholly surrounding said nozzle, said manifolding means being adjustably rotatable about said nozzle and independent of the releasable mount of said nozzle insert, a plurality of angularly spaced jet conduits carried by said ring and communicating with said manifolding means, said jet conduits extending in the downstream direction and discharging downstream, from locations downstream with respect to said nozzle, and pressure-fluid supply means for said manifolding means, said last-defined means including a pressure-fluid supply connection that is fixedly mounted to said nozzle.

2. The improvement of claim 1, in which the downstream ends of said jet conduits are radially inwardly inclined for substantial convergence of their respective discharge axes at substantially the nozzle-discharge axis and at a location downstream from the discharge location of said jet conduits.

3. As an article of manufacture, a rotationally adjustable manifolding ring, comprising a first ring member having a cylindrical bore adapted to fit the cylindrical periphery of a flame-spraying nozzle, means for selectively clamping said first ring member in fitted assembly to such a nozzle, a second ring member rotationally adjustable with respect to said first ring member, interengaging means coacting between said ring members to axially retain the same, adjacent surfaces of said ring members being contoured to define an annular pressure-fluid manifold therebetween, pressure-fluid inlet means at one angular location on said first ring member and communicating with said pressure-fluid manifold, and at least one jet conduit communicating with said manifold and forming part of said second ring member and extending generally parallel to the axis of said bore for generally axially directed discharge of manifold pressure fluid.

4. The article of claim 3, wherein said ring members have telescopically overlapping cylindrical surfaces, the manifold being defined at least in part by a circumferentially continuous groove in one of said surfaces.

5. The article of claim 4, in which circumferentially continuous seal means cooperates between said ring members at said surfaces and on opposite axial sides of said groove.

6. The article of claim 3, in which said jet conduit is one of two at diametrically opposite locations on said second ring member, both jet conduits terminating at and being adapted to discharge from the same general axial location.

7. The article of claim 6, in which both said jet conduits are adapted to discharge both radially inwardly and axially outwardly.

8. As an article of manufacture, a flame-sprayer nozzle tube having a cylindrical outer surface, a flange member fixed to said tube and having a cylindrical bore in radially spaced concentric overlap with said cylindrical outer surface, a rotatable ring member having a cylindrical outer surface in running-clearance overlap with said cylindrical bore, two O-ring seals coacting between said flange member and said ring member at axially spaced regions of said running-clearance overlap, thereby defining a circumferentially continuous pressure-fluid manifold region between said seals, a pressure-fluid inlet connection to said flange member at one angular location and communicating with said manifold region, and a pair of diametrically opposed jet-discharge ports on said ring member in communication with said manifold region and having discharge axes directed in the discharge direction of said nozzle.

9. The article of claim 8, in which each of said jet-discharge ports comprises an elongate tubular conduit secured to said ring member and in communication with said manifold region.

10. The article of claim 8, in which said manifold region is additionally defined by a circumferentially continuous radially outward groove in said ring member and axially between said seals.

11. As an article of manufacture, a flame-sprayer nozzle tube having a cylindrical outer surface, a flange member fixed to said tube and having a cylindrical bore in radially spaced concentric overlap with said cylindrical outer surface, a rotatable ring member having a cylindrical outer surface in running-clearance overlap with said cylindrical bore, two O-ring seals coacting between said flange member and said ring member at axially spaced regions of said running-clearance overlap, thereby defining a circumferentially continuous pressure-fluid manifold region between said seals, a pressure-fluid inlet connection to said flange member at one angular location and communicating with said manifold region, and a plurality of jet-discharge ports, on axes that are equally spaced about the axis of said ring member, said ports communicating with said manifold region and having discharge axes directed in the discharge direction of said nozzle.

12. The article of claim 11, in which said discharge axes diverge from the ring member axis in the discharge direction of said nozzle.

13. The article of claim 11, in which said discharge axes converge toward the ring member axis in the discharge direction of said nozzle.

14. The article of claim 11, in which selectively releasable axial-retaining means coacts between said flange and ring member, whereby ring members of different discharge-jet configuration may be selectively assembled to and releasably retained with respect to said flange member.

15. The article of claim 12, in which said retaining means comprises a radially outward groove formation in said ring member at an axial location outside the axial range spanned by said O-ring seals, and a radially movable retaining element carried by said flange member and removably engageable in said groove formation.

16. As an article of manufacture, a flame-sprayer nozzle tube having a cylindrical outer surface, a flange member fixed to said tube and having a cylindrical bore in radially spaced concentric overlap with said cylindrical outer surface, a rotatable ring member having a cylindrical outer surface in running-clearance overlap with said cylindrical bore, two O-ring seals coacting between said flange member and said ring member at axially spaced regions of said running-clearance overlap, thereby defining a circumferentially continuous pressure-fluid manifold region between said seals, a pressure-fluid inlet connection to said flange member at one angular location and communicating with said manifold region, and a circumferentially continuous jet-discharge port communicating with said manifold region and characterized by a locus of downstream discharge which is symmetrical about the ring-member axis.

17. As an article of manufacture, an annular discharge-jet insert-ring member for releasable assembly to the cylindrical bore of a mounting flange having a gas-supply port discharging locally between axial ends of the bore, said ring member having axially spaced O-ring grooves to enable O-ring sealed rotatable support of the ring member in the mounting flange with the O-rings on opposite sides of the gas-supply port, said ring member having a circumferentially continuous radially outward groove between said O-ring grooves to thereby define a circumferentially continuous manifold when thus assembled in the flange bore, said ring member having discharge-port means in communication with the manifold groove and directed for discharge at one to the exclusion of the other of the axial ends of said ring member.

18. The article of claim 3, in which said jet conduit comprises two elongate tubular members in longitudinally adjustable telescoped relation, one of said tubular members being mounted to said second ring member and the other of said tubular members having a jet-discharge outlet.

19. The article of claim 8, wherein said ring member includes circumferentially extending externally exposed means for imparting rotary displacement to said ring member.

20. The article of claim 8, and including annular bushing means with means for removable attachment of the same to said flange member, for concentric piloted mounting of said nozzle tube in a workpiece bore to be flame sprayed, the outer dimension of said bushing being selected for longitudinally slidable substantially concentric sliding engagement with the workpiece bore.

* * * * *